US006561865B2

(12) United States Patent
Jacobs

(10) Patent No.: US 6,561,865 B2
(45) Date of Patent: May 13, 2003

(54) SYSTEM FOR POSITIONING A RECTANGULAR CONE FOR A CRT

(75) Inventor: Peter Antonius Johannes Jacobs, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 267 days.

(21) Appl. No.: 09/829,787

(22) Filed: Apr. 10, 2001

(65) Prior Publication Data

US 2001/0035709 A1 Nov. 1, 2001

(30) Foreign Application Priority Data

Apr. 12, 2000 (EP) ..... 00201314

(51) Int. Cl.[7] ..... H01J 9/46
(52) U.S. Cl. ..... 445/66; 269/908

(58) Field of Search ..... 445/66; 269/908

(56) References Cited

U.S. PATENT DOCUMENTS 4,874,982 A 10/1989 Overdijk et al. ..... 313/440

*Primary Examiner*—Sandra O'Shea
*Assistant Examiner*—Sumati Krishnan

(57) ABSTRACT

A positioning system (20) for positioning a cone part of or for a CRT comprises a first and a second positioning means (22, 23) at positions corresponding to two corners of a side of a rectangle, and a third positioning means (21) at a position in the middle of the opposite side. The first and second means (22, 23) have a saddle-shaped contact surface, which is convex in the direction (51) from the tapered end to the wide end and concave (radius of curvature R) towards a central part of the rectangle, a contact surface of the third positioning means (21) is convex in the direction (51) from the tapered end to the wide end and convex or flat in a plane through the contact surfaces of the positioning means.

4 Claims, 5 Drawing Sheets

SYSTEM FOR POSITIONING A RECTANGULAR CONE FOR A CRT

The invention relates to a system for positioning a cone part for a CRT, the cone part having a tapered and a wide end.

The invention further relates to a method of manufacturing a CRT comprising a method step in which a cone part having a tapered end and a wide end of or for a CRT is positioned in a positioning system.

Cathode ray tubes (CRTs) are used in display devices such as television apparatuses, computer monitors and radar devices.

A CRT comprises a glass envelope with a cone part. During manufacture of the CRT, the cone part is treated in the different stages of manufacture of the CRT, for instance, when the sealing edge is made and when the front part and the cone part are attached to each other, when an electron gun is provided in a neck part of the CRT and when reference areas are provided on the cone part. In these method steps, the cone part is positioned in a positioning system by which the cone part is centered, i.e. its position is controlled and determined to within a certain accuracy. The cone part has a tapered end and a wide end. The conventional positioning system comprises three positioning means which form three corners of a triangle having sides of equal length. The positioning means are conventionally ball-shaped. The three positioning means form a reference frame for handling the cone. The more accurate the reference frame, the better the position of reference areas, sealing edge and display window and electron gun can be controlled with respect to each other. A better control of such positions enhances, amongst others, the location of the electron beams in operation and the quality of the displayed image.

A conventional CRT comprises a glass envelope with a cone part having a tapered end adjoining a neck part. This neck part accommodates an electron gun for generating one or more electron beams. Deflection means for deflecting the electron beam(s) surrounds this tapered end and the neck part. A display window is attached to a wide part of the cone. There is an ever greater tendency and desire to enhance the image quality, increase the flatness of the display window of the CRT and decrease the depth and weight of the CRT. These tendencies and desires exclude each other to some extend and a compromise has to be found. Conventional CRTs have a round cone part, i.e. the tapered end of the cone part is substantially circular in cross-section. To find a better compromise, the tapered end of the cone is preferably manufactured in such a way that it has a substantially rectangular cross-section. For such a cross-section, the (coils of the) deflection means can, on average, be brought closer to the electron beams, allowing a better control of the deflection and location of the electron beams and resulting in an increase of the quality of the image and a decrease of the energy needed to deflect the electron beams. However the inventors have found that, when a conventional positioning system is used for a cone part having a tapered end a substantially rectangular cross-section, the accuracy of determining the position of such a cone part leaves much to be desired. The inaccuracies are substantially larger than for cone parts having a tapered end with a substantially circular cross-section. This decrease of the positioning accuracy reduces or may even eliminate the positive effects of using a cone part with a substantially rectangular cross-section. For simplicity 'a cone part having a tapered end with a substantially rectangular cross-section' is hereinafter sometimes also referred to as 'a rectangular cone part'.

It is therefore an object of the invention to improve the accuracy with which the cone part is positioned and thereby the eventual quality of the CRT and/or to reduce the weight of the CRT and/or decrease the time needed for centering the cone.

To this end, the positioning system in accordance with the invention is characterized in that the system comprises a first and a second positioning means at positions substantially corresponding to two corners of a side of a rectangle, and a third positioning means at a position substantially corresponding to the middle of a side of the rectangle opposite the above-mentioned side, the first and second means having a contact surface which is convex in a direction from the tapered end to the wide end and concave towards a central part of the rectangle, the third positioning means having a contact surface which is convex in a direction from the tapered end to the wide end, and convex or flat in a plane through the contact surfaces of the positioning means. The third positioning means may be, for instance, ball-shaped, in which case the radius of curvature of the surface of the third positioning means is at least the same throughout at or near the contact surface. It may also have a cylindrical, or substantially ellipsoidal shape, or any shape in between. The contact surfaces of the first and second positioning means may be, and preferably are, formed as a hyperboloid, the hollow side of the hyperboloid facing the cone part.

Preferably, the first and second means have the same shape.

The shape and form of the contact surfaces (i.e. the surface engaging the cone part) and the relative position of the positioning means guide the cone part to an accurate position when a rectangular cone part is positioned in the positioning means, two of the corners being positioned by the first and second means and the opposite side being positioned by the third means.

Preferably, the normal vectors at the contact areas substantially cross each other at a point substantially lying on a line through the center of the rectangle and perpendicular to the rectangle. During positioning the contact areas exert forces on the cone part. These forces are substantially aligned along the normal vectors on the contact surfaces. When the normal vectors cross each other at a single point and the cone part is properly aligned, the total force exerted on the cone part is minimal and there is no torque exerted on the cone part.

The positioning system is particularly advantageous when used to position CRT's having a tapered end with substantially rectangular cross-sections.

The method of manufacturing a CRT in accordance with the invention is characterized in that a cone part having a tapered end with a substantially rectangular cross-section and a wide end, the tapered end having two corner parts and an opposite side, is positioned in a positioning system which comprises a first and a second positioning means at positions substantially corresponding to two corners of a side of a rectangle, and a third positioning means at a position substantially corresponding to the middle of a side of the rectangle opposite the above-mentioned side, the first and second means having a saddle-shaped contact surface, of a generally convex shape in a direction from the tapered end to the wide end, and a generally concave shape in a direction towards a central part of the rectangle, the third positioning means having a generally convex shape in a direction from the tapered end to the wide end, and a generally convex or flat shape in a plane through the contact surfaces of the positioning means, the corner parts of the cone part being positioned by the first and second positioning means and the opposite side being positioned by the third positioning means.

The positioning system may also be used to position a 'conventional CRT', i.e. one having a tapered end with a substantially circular cross-section. The saddle shaped surface of the first and second means reduces the Hertzian forces that occur in the cone when it is positioned on the means. Especially for larger cones (larger than 29'), the weight of the cone may cause such large Hertzian forces (=contact forces when one body contacts another) that cracks appear. Reduction of these contact forces reduces the risk of cracks (which may lead to implosion or weakness of the cone).

These and other aspects of the invention are apparent from and will be elucidated with reference to the embodiments described hereinafter.

In the drawings.

The Figures are not drawn to scale. In general, like reference numerals refer to like parts.

Figure 1:
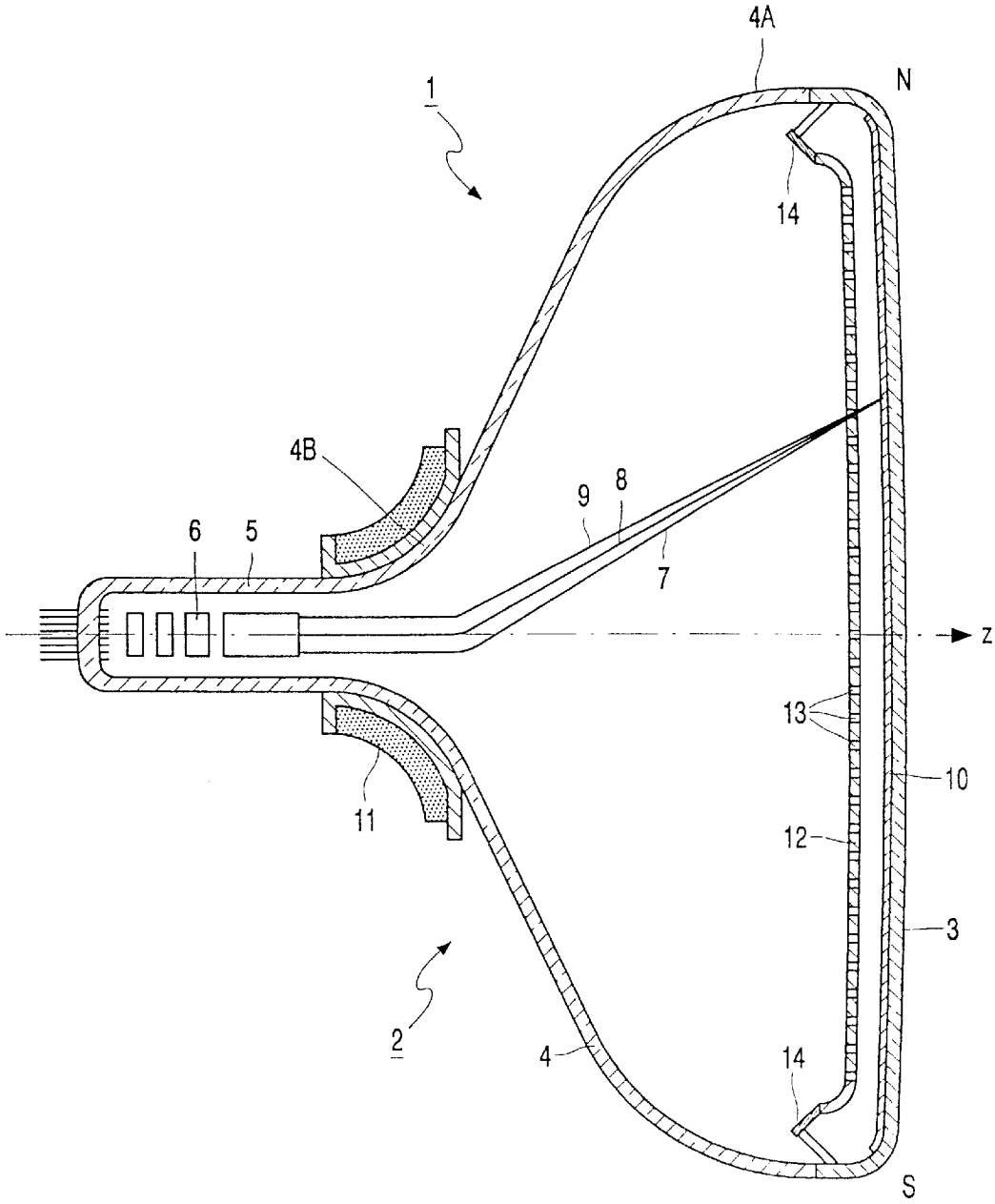
FIG. 1 is a side elevation, partly broken away, of a color display device having a color cathode ray tube with a color selection electrode.

The cathode ray tube 1 shown in FIG. 1 comprises an evacuated glass envelope 2 with a neck 5, a cone part 4 and a front or display panel 3, the outer surface of which may either be curved or flat. Display screen 10 having a pattern of, for example, lines or dots of phosphors luminescing in different colors (e.g. red, green and blue) may be arranged the inner side of the display panel. A frame 14 supports a thin mask 12 at a short distance form the display screen 10. The mask may be an apertured mask having circular or elongated apertures 13, or a wire mask. During operation of the tube, an electron gun system 6 arranged in the neck 5 generates electron beams 7, 8 and 9. These electron beams pass through the apertures 13 of mask 12 so that the phosphors will emit light. A deflection device 11 ensures that the electron beams systematically scan the display screen. The cone part 4 comprises a wide end 4A to which the display window is attached and a tapered end 4B around which the deflection unit is provided. Also indicated are the North (N), South (S), West (W) and East (E) side of the cone, in the usual denomination. The z-axis, which is the longitudinal axis of the cone, is also indicated. In a CRT, this axis corresponds, approximately to the path of the undeflected electron beams.

Figure 2A:
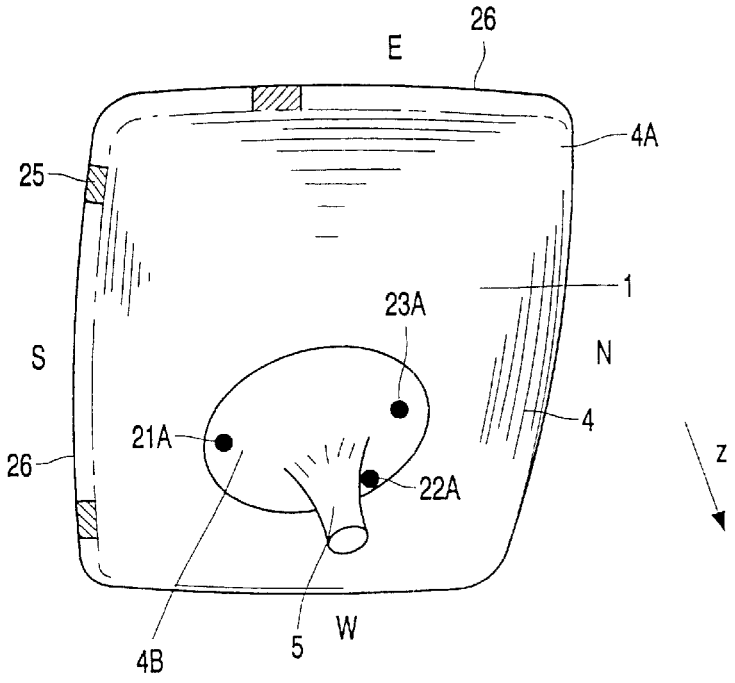
FIGS. 2A, 2B and 2C show schematically a known positioning system.
Figure 2B:
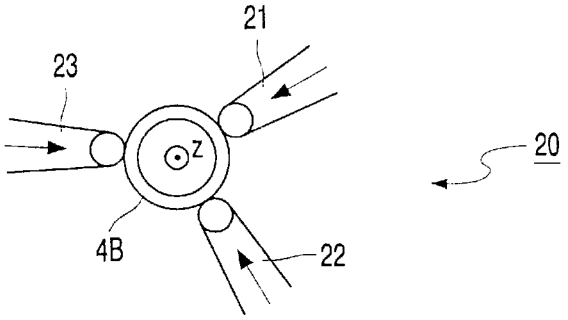
Figure 2C:
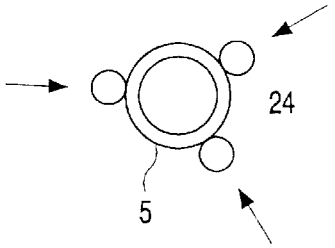

FIGS. 2A to 2C show schematically a known positioning system.

The cone part 4 of the CRT (in this example already provided with a neck part 5), is positioned in a positioning system 20 that comprises three substantially ball-shaped positioning means 21, 22 and 23, which make contact with the cone part at contact surfaces 21A, 22A and 23A on the tapered end 4B of cone part 4 (See FIG. 2B). The positioning system furthermore comprises a means 24 for positioning the neck. In this example, the means 24 comprises 3 balls or segments of balls between which the neck is clamped in a concentric position. In co-operation with the means 24 the three positioning means enable the cone part to be accurately positioned (see FIG. 2C). At least in the part where contact is to be made with the means 21, 22, 23, the cone part is substantially rotationally symmetric and hollow. The positioning means 21, 22, 23 determine a triangle with three sides of equal length. The cone part rests on the three contact surfaces and is thereby positioned. Once the cone part is positioned, several method steps may be performed. Reference protrusions 25 may be made, a sealing edge 26 may be ground and leveled, a display window (sometimes also called a 'panel') may be aligned and sealed to the cone, an electron gun may be inserted in the neck and attached to the neck. For all of these method steps it is important that the position of the cone part is and remains accurately determined.

The inventors have found that the known system and method do not yield results of the same accuracy for cone parts having a tapered end 4B which is not round, but are substantially rectangular, in cross-section as for cone parts with a round cross-sectional form. The use of cone parts of a substantially rectangular cross-section is advantageous because it allows the coils of the deflection system to be placed, on average, closer to the electron beams to be deflected. This allows larger deflection angles and/or a more accurate deflection of the electron beams. Such improvements in performance could, however, be undone if the accuracy with which different parts of the CRT viz-à-viz the cone part (or certain portions of the cone parts viz-à-viz other portions of the cone parts) are made, positioned or attached were reduced. For that reason, it is important that the cone part is accurately positioned when certain manufacturing or processing steps are performed on the cone part and/or parts are attached to the cone part, or when parts are machined. The known system and method as schematically shown in FIG. 2 leaves room for improvement.

Figure 3:
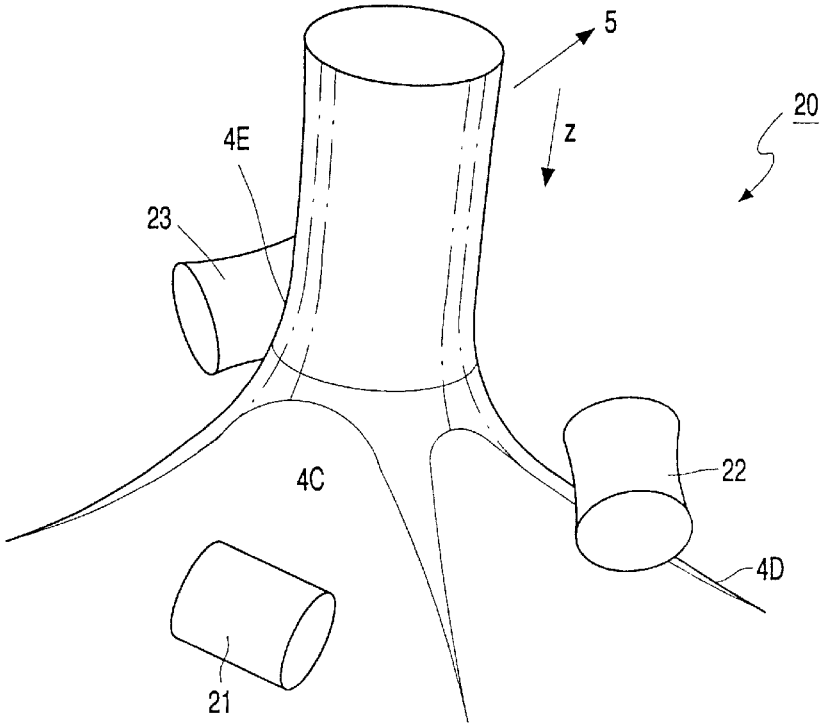
FIGS. 3, 4, 5 and 6 show schematically examples of positioning systems in accordance with the invention.

FIG. 3 illustrates in a perspective view a positioning system and method in accordance with the invention. The positioning system 20 comprises three positioning means 21, 22 and 23 in operation, one of said positioning means (21) touches a surface (4C) that is curved along the direction excluding from the tapered end to the wide end, i.e. flaring outwards, and is substantially uncurved in a direction within a plane perpendicular to the z-axis. The other two positioning means (22, 23) touch corner parts (4D,4E) of the substantial rectangular cross-section of the cone. The positioning means 21 has a contact surface which is convex (outwardly curved) (e.g. round) in a direction from the tapered end to the wide end and convex or flat in a direction towards a central part of said rectangle. The positioning means 22, 23 have contact surfaces which are convex in the direction from the tapered end to the wide end, and concave (inwardly curved) in the direction perpendicular to the z-axis. The saddle shape of the contact surfaces of means 22, 23 and the positioning of the means 22, 23 corresponding to the comers of the rectangular cross section of the cone, in combination with the roundness of the means 21 and its position at a side that is curved in one direction but more or less flat in the other, guides the rectangular cone to an accurate position when the cone is positioned in the positioning system.

Figure 4:
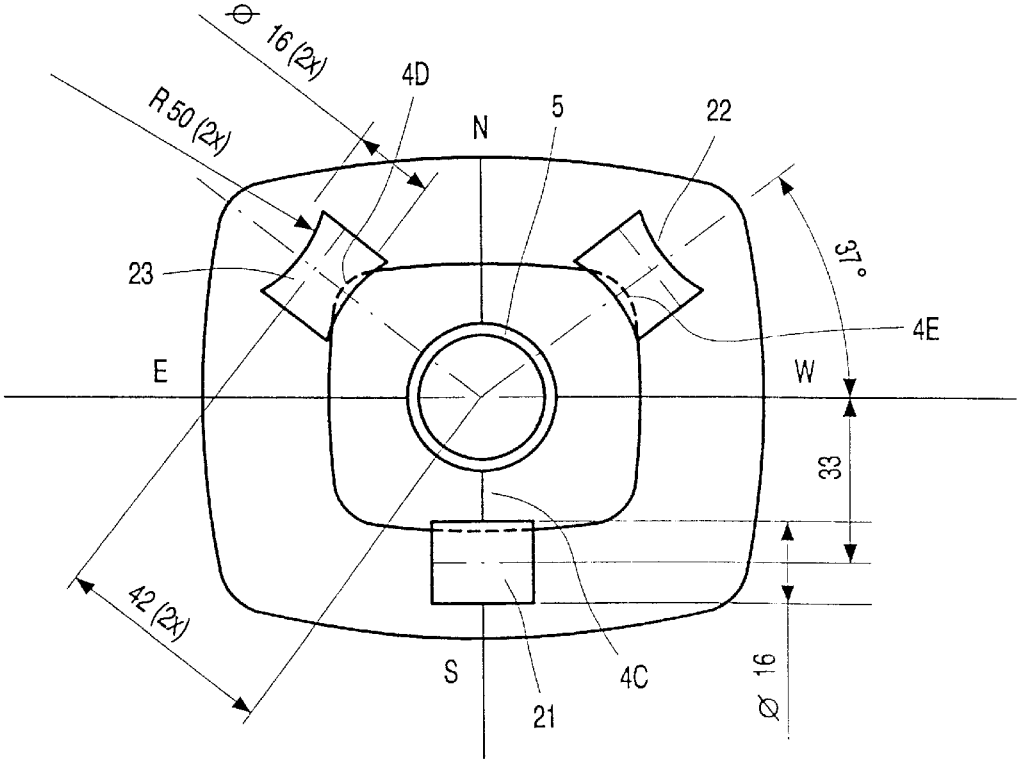

FIG. 4 shows an embodiment showing the relative positions of positioning means 21, 22 and 23 and the cone part and neck 5. Some, non-limiting measures for the radii of curvature or diameters of positioning means 21 to 23 are given, by way of example, as well as some measures for the relative positions of said means. It will be clear that, although these measures are realistic, they may be varied and are to some extent dependent on other parameters, such as the size of the cone and the rectangular cross-section of the tapered end of the cone part. The contact surfaces of the positioning means are the surfaces which, in operation, are in contact with the outer side surface of the cone part 4.

Figure 5:
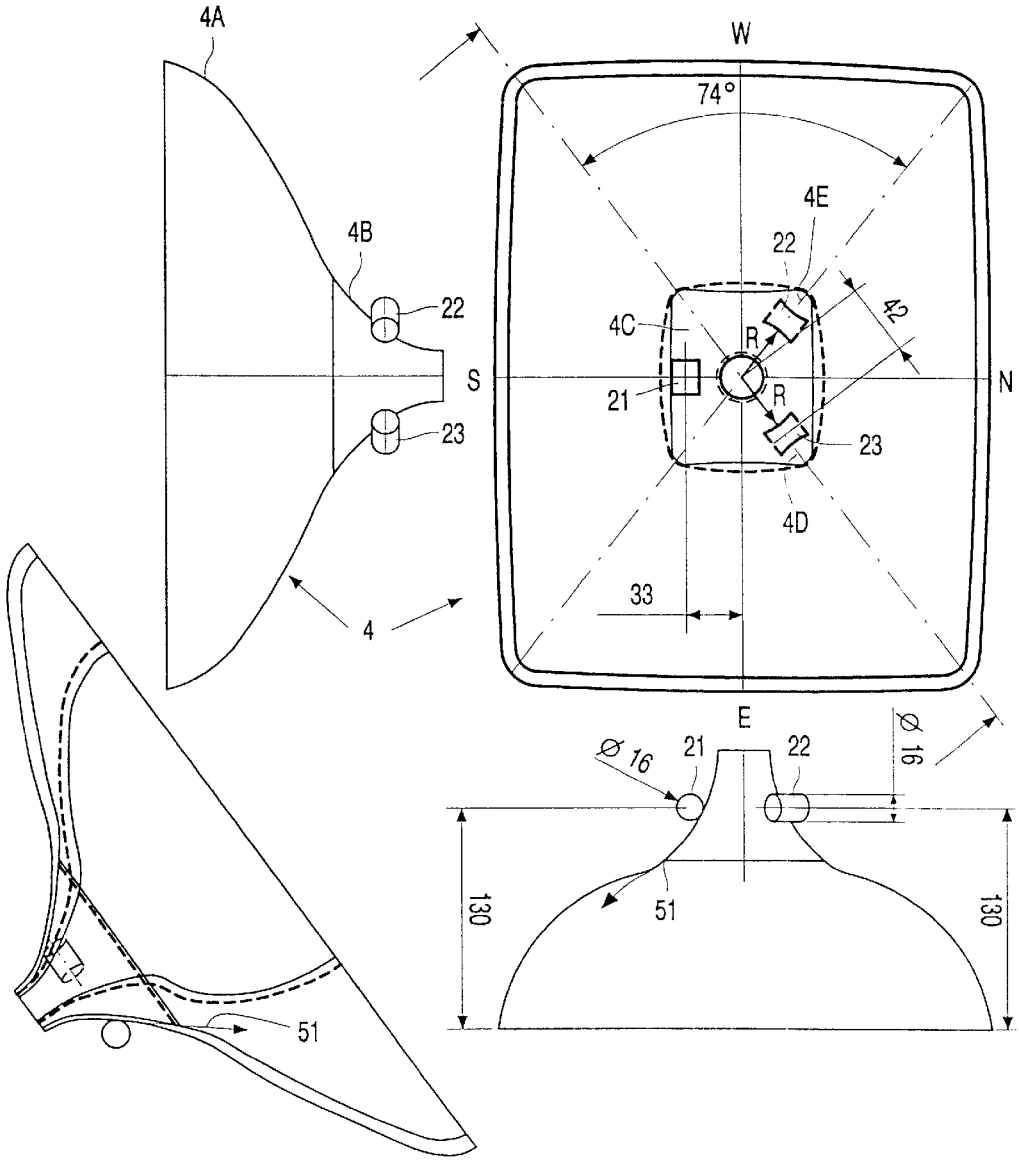

FIG. 5 shows the cone part 4 and the positioning means 21, 22 and 23 in different views. The contact area of positioning means 21 is convex in respect of direction 51 (the tangent line along the outer surface of the cone from the tapered end 4A to the wide end 4B) as are the contact areas of means 22 and 23. The contact area of means 21 is flat or convex in the plane through the contact surfaces. The contact surfaces of means 22 and 23 are concave in this plane, i.e. within said plane, these contact areas have radii of curvature R directed towards the center of the triangle formed by the contact areas.

Figure 6:
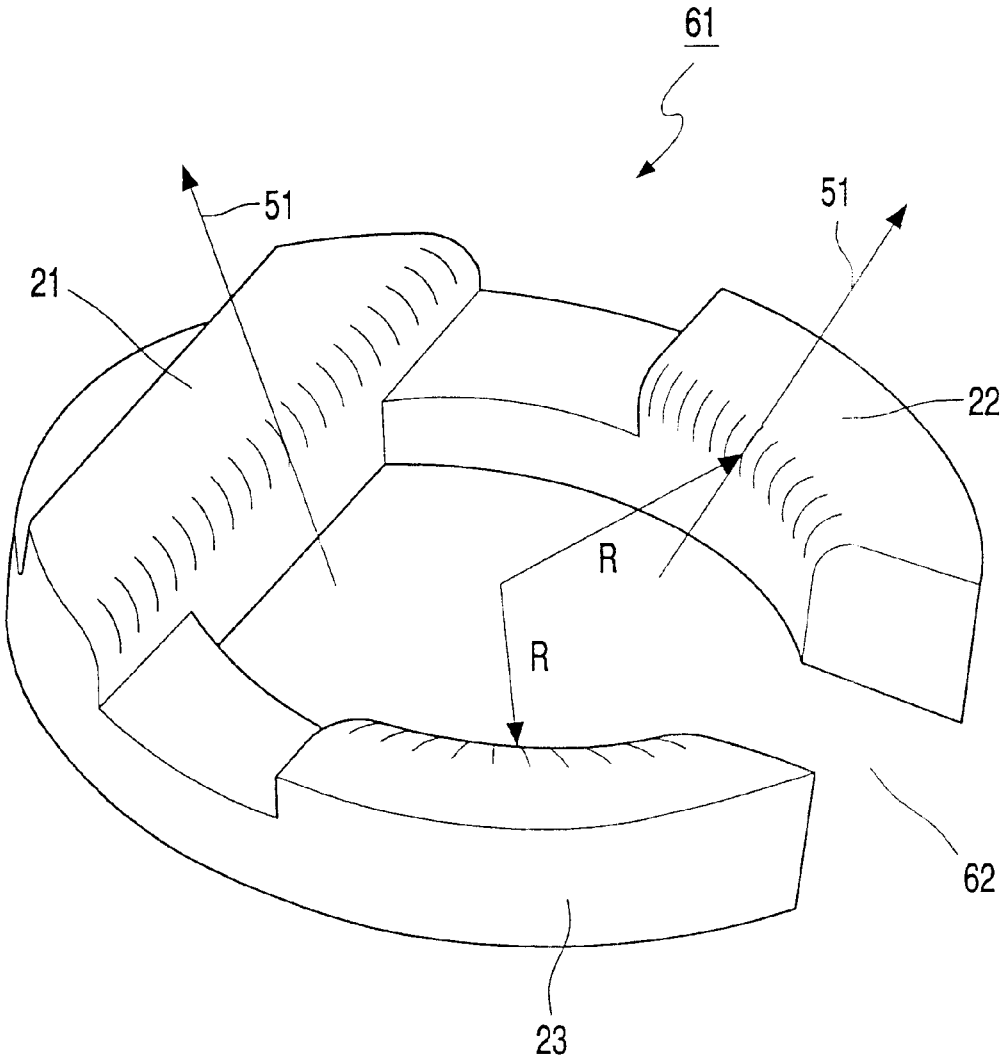

FIG. 6 shows a positioning system comprising a ring-shaped part 61 in which the three positioning means 21, 22 and 23 are integrated in a single structure. FIG. 6 shows clearly that all three positioning means have contact surfaces that are convex as viewed along directions 51, while means 21 have a contact surface that is convex or flat (in this example, flat) in the plane through the contact surfaces (which, in this example, roughly corresponds to a plane perpendicular to the z-axis and slightly below the upper surface of the ring 61), whereas means 22 and 23 have contact surfaces that are concave (hollow). Viewed in a plane perpendicular to the z-axis and through the contact areas, the contact areas of means 22 and 23 have radii of curvature R which are directed towards the central part of the triangle formed by the three contact areas.

Preferably, the normal vectors at the contact areas substantially cross each other at a point substantially lying on a line through the center of the rectangle and perpendicular to the rectangle. During positioning, the contact areas exert forces on the cone part. These forces are substantially aligned along the normal vectors on the contact surfaces. When the cone part is properly aligned, the total force exerted on the cone part is minimal and there is no torque exerted on the cone part. FIG. 6 shows all three positioning means integrated in one single structure. This is a preferred embodiment. The structure preferably has an opening 62, preferably between means 22 and 23 for allowing a neck part of a CRT to be inserted in the structure through the opening. This reduces the time needed for positioning the cone part and removing the cone part from the positioning means.

It will be clear that many variations are possible within the scope of the invention.

In summary the invention can be described as follows.

A positioning system (20) for positioning a cone part of or for a CRT comprises a first and a second positioning means (22, 23) at positions corresponding to two comers of a side of a rectangle, and a third positioning means (21) at a position in the middle of the opposite side. The first and second means (22, 23) have a saddle shaped contact surface, which is convex in the direction (51) from the tapered end to the wide end and concave towards a central part of the rectangle, while a contact surface of the third positioning means (21) is convex in the direction (51) from the tapered end to the wide end and convex or flat in a plane through the contact surfaces of the positioning means.

It is to be noted that the positioning system may also be used to position a 'conventional CRT', i.e. one having a tapered end with a substantially circular cross-section. The saddle shaped surface of the first and second means reduces the Hertzian forces that occur in the cone when it is positioned on the means. Especially for larger cones (larger than 29'), the weight of the cone may cause such large Hertzian forces (=contact forces when one body contacts another) that cracks appear. Reduction of these contact forces reduces the risk of cracks (which may lead to implosion or weakness of the cone). In such embodiments the relative positions of the contact surfaces may be different from embodiments for positioning CRTs having a tapered end with a rectangular cross-section. The contact surface for a 'conventional CRT'would preferably constitute the comer points of a triangle with sides of equal length.

In the method, the positioning system is used to position a cone part.

What is claimed is:

1. A positioning system (20) for positioning a cone part (4) having a tapered end (4B) and a wide end (4A) for a CRT comprising three positioning means (21, 22, 23), characterized in that the system comprises a first and a second positioning means (22, 23) at positions substantially corresponding to two corners of a side of a rectangle, and a third positioning means (21) at a position substantially corresponding to the middle of a side of the rectangle opposite the above-mentioned side, the first and second means (22, 23) having a contact surface which is convex in a direction (51) from the tapered end to the wide end and concave towards a central part of the rectangle, the third positioning means (21) having a contact surface which is convex in a direction (51) from the tapered end to the wide end, and convex or flat in a plane through the contact surfaces of the positioning means (21, 22, 23).

2. A system as claimed in claim 1, characterized in that the normal vectors at the contact areas substantially cross each other at a point substantially lying on a line through the center of the rectangle and perpendicular to the rectangle.

3. A system as claimed in claim 1 or 2, characterized in that the positioning means (21, 22, 23) are integrated in a single structure (61).

4. A method of manufacturing a CRT, the method comprising a step of positioning a cone part (4) of or for a CRT in a positioning system (20), characterized in that a cone part (4) having a tapered end (4B) with a substantially rectangular cross-section and a wide end (4A), the tapered end having two corner parts (4D, 4E) and an opposite side (4E), is positioned in a positioning system (20) which comprises a first and a second positioning means (22, 23) at positions substantially corresponding to two corners of a side of a rectangle, and a third positioning means (21) at a position substantially corresponding to the middle of a side of the rectangle opposite to above-mentioned side, the first and second means (22, 23) having a saddle-shaped contact surface, of a generally convex shape in a direction (51) from the tapered end to the wide end, and a generally concave shape in a direction towards a central part of the rectangle, the third positioning means (21) having a generally convex shape in a direction (51) from the tapered end to the wide end, and a generally convex or flat shape in a plane through the contact surfaces of the positioning means (21, 22, 23), the comer parts (4D, 4E) of the cone part being positioned by the first and second positioning means (22, 23) and the opposite side (4C) being positioned by the third positioning means.

* * * * *